United States Patent [19]

Smith

[11] 3,938,729

[45] Feb. 17, 1976

[54] DISPOSABLE TRAY

[75] Inventor: Donald Ferrand Smith, Clifton, N.J.

[73] Assignee: St. Regis Paper Company, New York, N.Y.

[22] Filed: Nov. 6, 1974

[21] Appl. No.: 521,260

[52] U.S. Cl. ..... 229/30; 40/154
[51] Int. Cl.² ..... B65D 5/22
[58] Field of Search ..... 229/31.FS, 31 R, 30; 40/154, 155

[56] References Cited

UNITED STATES PATENTS

| | | | |
|---|---|---|---|
| 1,528,361 | 3/1925 | Bashwimer | 40/154 |
| 2,065,804 | 12/1936 | Guyer | 229/30 |
| 2,144,646 | 1/1939 | Zalkind | 229/30 X |
| 2,203,737 | 6/1940 | Moore | 229/30 UX |
| 2,332,642 | 10/1943 | Johnson | 229/30 UX |
| 2,334,985 | 11/1943 | Berry | 229/30 |
| 2,430,609 | 11/1947 | Guyer | 229/30 UX |
| 2,641,858 | 6/1953 | Burr | 40/155 |
| 2,806,310 | 9/1957 | Boyd | 40/154 |

FOREIGN PATENTS OR APPLICATIONS

| | | | |
|---|---|---|---|
| 1,184,284 | 2/1959 | France | 40/154 |
| 197,862 | 4/1908 | Germany | 40/154 |

*Primary Examiner*—Davis T. Moorhead
*Attorney, Agent, or Firm*—Woodling, Krost, Granger & Rust

[57] ABSTRACT

A carrying tray is provided incorporating a top member of single face corrugated paper board which is bonded to a bottom member made of a single paper board. The bottom member extends beyond the top member and forms a substantially triangular beam bounding the perimeter of the top member to provide a rim for improving the stability and strength of the tray. A tab extending from one of the beams is adhesively bonded to an adjacent beam to provide strength at a corner of the tray. The tray can be economically and readily decorated using commercial printing systems such as flexographic gravure and silk screening.

19 Claims, 6 Drawing Figures

DISPOSABLE TRAY

The foregoing abstract is merely a resume of one general application, is not a complete discussion of all principles of operation or applications, and is not to be construed as a limitation on the scope of the claimed subject matter.

BACKGROUND OF THE INVENTION

1. Field of the Invention

This invention relates to paper receptacles, folded blank boxes, and trays.

2. Description of the prior Art

The prior art has known many types of disposable trays. A difficulty encountered in all of these prior art trays is the problem of manufacturing a tray which is strong and yet economical to permit large distribution and use. Many satisfactory designs of prior art trays failed commercially due to excessive manufacturing costs. These trays generally required a complex machine in order to fold the material to form the tray structure. Many prior art trays failed to provide a rim along one edge of the tray which was secured to the rim along an adjacent edge of the tray. Most of the prior art trays were made of a molded fiber which does not permit easy decoration.

One prior art tray incorporated a single face corrugated paper board for the bottom member and a single paper board for a top member which top member was folded and secured to the bottom member to form a rim of the tray. This tray was satisfactory but the tray was not easily manufactured since the bottom member could not be properly registered relative to the top member using state of the art folding machines.

Therefore an object of this invention is to provide a disposable tray manufactured from cellulose fiber and adhesive which is both light and strong.

Another object of this invention is to provide a disposable tray which may be readily decorated using commercial printing systems such as flexographic gravure and silk screening.

Another object of this invention is to provide a disposable tray wherein a commercial quality single faced corrugated paper board forms a top member of the tray and a folded single paper board forms the sides or rim and bottom of the tray.

Another object of this invention is to provide a disposable tray including a tab for interconnection between adjacent rim portions to provide additional strength to the tray.

Another object of this invention is to provide a disposable tray which is easy to manufacture and is inexpensive.

SUMMARY OF THE INVENTION

The invention may be incorporated in a tray, comprising in combination, a top member having a first and second side with said first side comprising a top surface of the tray; a bottom member having a first and a second side with said second side comprising a bottom surface of the tray; means mounting said second side of said top member to said first side of said bottom member with one of said top and bottom members extending beyond the other of said top and bottom members forming a first and a second rim portion, each of said rim portions having a first fold line; means for mounting said rim portions to said other of said top and bottom members establishing obtuse folds at said first fold lines forming a rim for the tray; and means connecting said first rim portion to said second rim portion to secure said rim portions relative to one another.

DESCRIPTION OF THE PREFERRED EMBODIMENT

Figure 4:
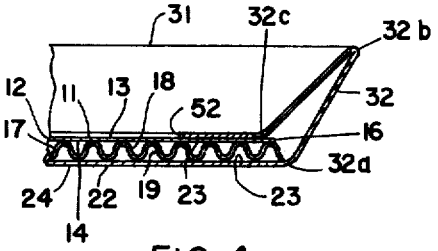
FIG. 4 is an enlarged sectional view along line 4—4 of FIG. 1.
Figure 5:
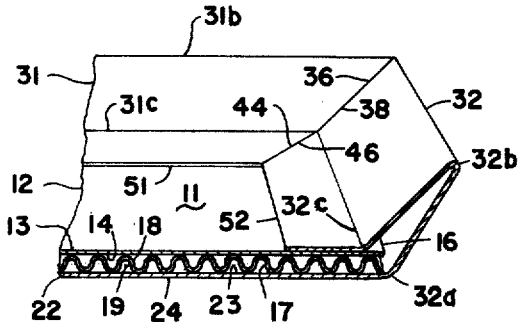
FIG. 5 is an enlarged perspective view of a section of the tray generally along line 5—5 in FIG. 1.
Figure 6:
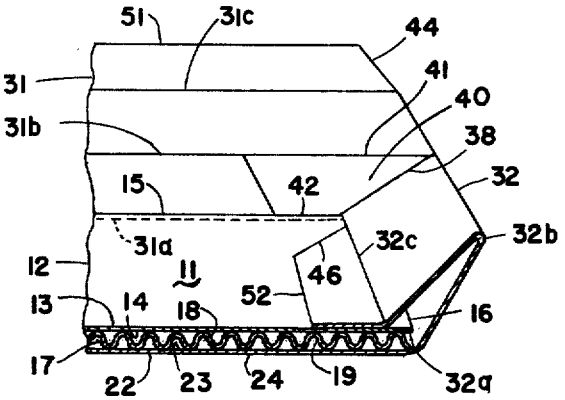
FIG. 6 is a view similar to FIG. 5, wherein the rear rim has not been folded to show a tab for connecting adjacent rim portions.

FIGS. 1–6 illustrate the preferred embodiment of a disposable tray 9 incorporating a top member 11 shown in FIGS. 4, 5, and 6 to comprise a top sheet 12 having a first side 13 and a second side 14 and including a corrugated intermediate member 17, having corrugated peaks on a first side 18 and corrugated peaks on a second side 19. The corrugated peaks on the first side 18 of the intermediate member 17 are adhesively bonded to the second side 14 of the top sheet 12 to form the top member 11. The top sheet 12 may have a thickness range of 0.127 to 0.300 mm. with the preferred thickness being 0.178 mm. whereas the intermediate member 17 may have a thickness range of 0.80 to 0.178 mm. and a corrugation height range of 2.50 to 4.20 mm. with a preferred thickness of 0.089 mm. and a preferred height of 3.57 mm. The top member 11 is commercially referred to as "A" flute having a height of 3.57 mm. and a pitch of 7.81 mm. A bottom member 22 has a first side 23 and a second side 24 with the second side 24 comprising the bottom of the tray 9. Many types of adhesives are suitable for binding the top member 11 to the bottom member 22 including Industrial Adhesive Company's P 80-2 polyvinyl acetate adhesive. The first side 23 of the bottom member is adhesively mounted to the second side of the top member 11 and more specifically to the peaks on the second side 19 of the intermediate member 17 with the bottom member 22 extending beyond a first and a second edge 15 and 16 of the top member 11 to provide a first and a second rim portion 31 and 32, respectively. The intersection of the first and second edges 15 and 16 forms a corner 21. The bottom member 22 may have a thickness range of 0.357 to 0.765 mm. with a preferred thickness of 0.460 mm.

The first rim portion 31 includes a first, second and a third fold line **31*a*, 31*b* and 31*c*, which are sequentially spaced from and substantially parallel to the first edge 15. The second rim portion 32 includes a first, second and a third fold line 32*a*, 32*b* and 32*c* which are sequentially spaced from and substantially parallel to the second edge 16.**

Fold lines are commonly referred to as scores or impressions in the paper blank so that the paper blank may be accurately folded at a subsequent time. The first rim portion 31 includes a bottom corner edge 35 located between the first and second fold lines **31*a* and 31*b* and includes a top corner edge 36 located between the second and third fold lines 31*b* and 31*c*. An edge 44** extends beyond the third fold line 31*c*. The second rim portion 32 includes a bottom corner edge 37 located between the first and second fold lines 32*a* and 32*b* and a notch fold line 38 located between the second and third fold lines 32*b* and 32*c*. A notch 39 having a notch edge 46 extends beyond the third fold line 32*c* and defines in conjunction with the notch fold line 38 a tab 40 including a first tab edge 41 and a second tab edge 42. The first and second rim portions 31 and 32 include first and second edges 51 and 52 respectively.

Figure 1:
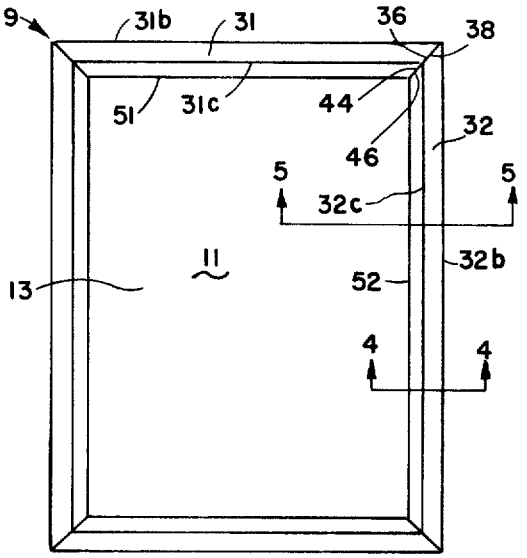
FIG. 1 is a top view of a disposable tray incorporating the invention.
Figure 2:
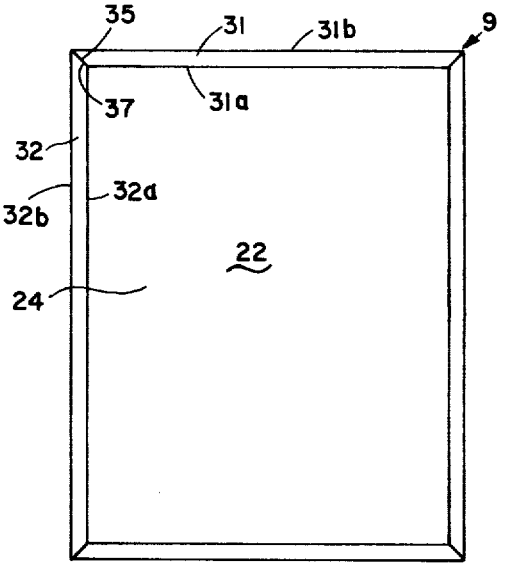
FIG. 2 is a bottom view of the tray shown in FIG. 1.
Figure 3:
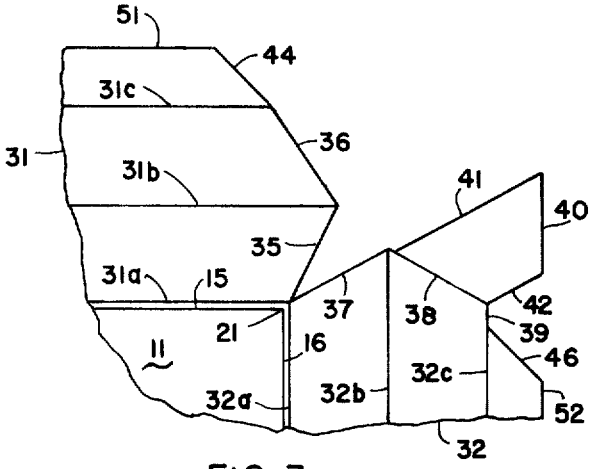
FIG. 3 is an enlarged top view of the material used to form the upper right corner of the tray in FIG. 1.

FIGS. 4, 5 and 6 show the first side 23 of the bottom member 22 being adhesively mounted to the first side 13 of the top member 11 forming obtuse folds at the first and third fold lines 31*a*, 32*a*, 31*c* and 32*c* and forming acute folds at the second fold lines 31*b* and 32*b*. Many types of adhesives such as water based or hot melt adhesives may be used for this mounting including Amsco No. 107. FIG. 2 illustrates the bottom corner edge 35 of the first rim portion 31 engaging the bottom corner edge 37 of the second rim portion 32, whereas FiG. 5 shows the coincidence of the top corner edge 36 of the first rim portion 31 with the notch fold line 38 of the second rim portion 32. Consequently the rim portions form two sides of a triangular beam between the first and third fold lines when viewed along a cross-section of the rim for example between fold lines 32*a* and 32*c* in FIG. 4. The first fold 32*a* may vary between 45° and 75 ° with a preferred angle being 60° whereas the third fold 32*c* may vary betwen 35° and 55° with the preferred angle being 45° to provide a suitable stacking factor.

FIG. 6 is similar to FIG. 5 except that the first rim portion 31 is in an intermediate stage of manufacture and is shown folded only along the first fold line 31*a* to show the mounting of the tab 40 of the second rim portion 32 to the first rim portion 31. The tab 40 is folded along the notch fold line 38 with the first tab edge 41 being substantially coincident with the second fold line 31*b* and with the second tab edge 42 being substantially coincident with the first fold line 31*a* of the first rim portion. The notch edge 46 is shown in FIG. 5 to be established along a line bisecting the corner and is substantially adjacent to the edge 44 of the first rim protion 31.

The advantages of the foregoing invention over the prior art includes the beam or the rim formed by the triangular structure between the first and third fold lines. However, this principle can be varied by putting the third fold line in the top member 11 in which case only one obtuse angle would be formed in the bottom member 22. In addition, the acute angle formed at the second fold line may be replaced by various other configurations as long as the bottom member returns upon itself to join with the top member 11. A triangular configuration of the rim furnishes the strength to the disposable tray. In addition, the cellulose fiber from which the tray is constructed makes it both economical and readily decorable using commercial printing systems. Most prior art disposable trays are made of a molded fiber which does not permit easy decoration.

The invention has been described as a tray comprising in combination: a top member 11 having a first side 13 and a second side 19 with the first side 13 comprising a top surface of the tray. A bottom member 22 has a first side 23 and a second side 24 with the bottom side 24 comprising a bottom surface of the tray. The second side 19 of the top member 11 is mounted to the first side 23 of the bottom member 22 with one of the top and bottom members extending beyond the other forming a first and second rim portion 31 and 32, respectively. Either the top member 11 or the bottom member 22 may extend beyond the other but in this embodiment the bottom member 22 extends beyond the top member 11 but the converse is equally applicable to this invention. The first and second rim portions 31 and 32 can have a first fold line 31*a* and 32*a*, respectively. The rim portions 31 and 32 are mounted to the other of the top and bottom members and in this embodiment shown to be the top member 11 establishing obtuse folds at the first fold lines 31*a* and 32*a* to form a rim for the tray. The invention include means shown as tab 40 connecting the first rim portion 31 to the second rim portion 32 to secure the rim portions relative to one another.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention as hereinafter claimed.

What is claimed is:

1. A tray, comprising in combination:

a top member having a first and a second side with said first side comprising a top surface of the tray;

a bottom member having a first and a second side with said second side comprising a bottom surface of the tray;

means mounting said second side of said top member to said first side of said bottom member with one of said top and bottom members extending beyond the other of said top and bottom members forming a first and a second rim portion;

each of said rim portions having a first fold line;

means for mounting said rim portions to said other of said top and bottom members establishing obtuse folds at said first fold lines and establishing acute folds located beyond said other of said top and bottom members forming a rim for the tray;

and means connecting said first rim portion to said second rim portion to secure said rim portions relative to one another.

2. A tray as set forth in claim 1 wherein said connecting means includes a tab extending from said second rim portion for mounting to said first rim portion.

3. A tray, comprising in combination:

A top member having a first and a second side with said first side comprising a top surface of the tray;

said top member having a first and a second edge;

a bottom member having a first and a second side with said second side comprising a bottom surface of the tray;

means mounting said second side of said top member to said first side of said bottom member with said bottom member extending beyond said first and second edges of said top member forming a first and a second rim portion, respectively;

each of said rim portions having a first, second and a third fold line sequentially spaced from said edges of said top member;

and means for mounting said rim portions to said top member establishing obtuse folds at said first and third fold lines forming a rim for the tray.

4. A tray as set forth in claim 3, wherein said means mounting said second side of said top member to said first side of said bottom member includes an intermediate member.

5. A tray as set forth in claim 4, wherein said intermediate member has corrugated peaks.

6. A tray as set forth in claim 3, wherein said fold lines of each of said first and second rim portions are substantially parallel to said first and second edges, respectively.

7. A tray as set forth in claim 3, wherein said means for mounting said rim portions to said top member includes forming a first and a second beam extending outwardly from said first and second edges of said top member, respectively.

8. A tray as set forth in claim 3, including a tab extending from said second rim portion;

and means mounting said tab to said first rim portion to secure the first rim portion relative to the second rim portion.

9. A tray as set forth in claim 3, wherein said mounting means includes adhesive means.

10. A tray as set forth in claim 3, wherein acute folds are formed at said second fold lines.

11. A tray as set forth in claim 3, wherein said bottom member forms two sides of a triangle between said first and third fold lines along a cross-section of said rim.

12. A tray, comprising in combination:

a top member having a first and a second side with said first side comprising a top of the tray;

said top member having a first and a second edge forming a corner at the intersection thereof;

a bottom member having a first and second side with said second side comprising a bottom surface of the tray;

means mounting said second side of said top member to said first side of said bottom member with said bottom member extending beyond said first and second edges of said top member forming a first and a second rim portion, respectively;

each of said rim portions having a first, second and a third fold line sequentially spaced and substantially parallel to said edges of said top member;

each of said rim portions having a bottom corner edge between said first and second fold lines;

said first rim portion having a top corner edge between said second and third fold lines;

said second rim portion having a notch fold line;

said second rim portion having a tab adjacent said notch fold line;

means for mounting said first side of said rim portions to said first side of said top member establishing obtuse folds at said first and third fold lines and acute folds at said second fold lines with said bottom corner edges engaging one another forming a first and a second beam about said first and second edges of said top member, respectively;

and means for mounting said tab to said first beam to secure the first beam relative to said second beam to provide a rim for the tray.

13. A tray as set forth in claim 12, wherein said top member includes a top sheet having a first and a second surface wherein said first surface comprises the top of the tray;

said top member having an intermediate member having corrugated peaks on a first and a second side of the intermediate member;

adhesive means for mounting said corrugated peaks of said first side of said intermediate member to said second side of said top sheet with said intermediate member extending to the first and second edges of said top member;

and said second side of said intermediate member comprising said second side of said top member.

14. A tray as set forth in claim 12, wherein said top corner edge of said first rim portion is substantially coincident with said notch fold line.

15. A tray as set forth in claim 12, including a notch between said second and third fold lines wherein said notch includes a notch edge which is substantially parallel to an edge of said first rim portion extending beyond said third fold line.

16. A tray as set forth in claim 12, wherein said tab includes a first and a second tab edge;

said first tab edge being substantially coincident with said second fold line of said first rim portion;

and said second tab edge being substantially coincident with said first fold line of said first rim portion.

17. A substantially rigid tray, comprising in combination;

a top member having a first and a second edge forming a corner at the intersection thereof, said top member including a top sheet having a first and a second side and an intermediate member having a first and a second side;

said intermediate member having corrugated peaks on said first and second sides;

adhesive means for mounting said corrugated peaks of said first side of said intermediate member to said second side of said top sheet with said intermediate member extending to said first and second edges of said top member;

a bottom member having a first and a second side;

adhesive means for mounting said first surface of said bottom member to said corrugated peaks of said second side of said intermediate member with said bottom member extending beyond said first and second edges of said top member forming a first and a second rim portion, respectively;

each of said rim portions having a first, second and a third fold line sequentially spaced and substantially parallel to said first and second edges of said first member, respectively;

each of said first and second rim portions having a bottom corner edge between said first and second fold lines;

said first rim portion having a top corner edge between said second and third fold lines;

said second rim portion having a notch fold line between said second and third fold lines;

said second rim portion having a notch extending beyond said third fold line;

said second rim portion having a tab defined by said notch and said notch fold line with said tab having a first and a second tab edge;

adhesive means for mounting said first side of said rim portions to said first side of said top member establishing obtuse folds at said first and third fold lines and acute folds at said second fold lines with said bottom corner edges engaging one another forming a first and a second beam bounding said first and second edges of said top member, respectively;

and adhesive means for mounting said tab to said first beam with said first and second tab edge being substantially coincident with said second and first fold lines respectively to secure the first beam relative to said second beam to provide a rim for the tray.

18. A tray as set forth in claim 17, wherein said bottom member includes a cellulose fiber member.

19. A tray as set forth in claim 17, wherein said top member includes a single face corrugated cardboard.

* * * * *